US005533464A

United States Patent [19]

Todd

[11] Patent Number: 5,533,464

[45] Date of Patent: Jul. 9, 1996

[54] SILHOUETTE IMAGE FLAG WITH CUT-OUTS AND IMPROVED FLAG SUSPENDING ASSEMBLY

[76] Inventor: Alvin E. Todd, P.O. Box 924, Pigeon Forge, Tenn. 37868-0924

[21] Appl. No.: 263,525

[22] Filed: Jun. 22, 1994

[51] Int. Cl.[6] ..... G09F 7/00; G09F 17/00

[52] U.S. Cl. ..... 116/174; 116/173; 40/601; 40/602; 40/607; D11/165; D11/173

[58] Field of Search ..... 116/173, 174, 116/175, 306, 307, 321; 40/218, 534, 584, 601, 602, 603, 604, 610, 606, 607; 403/326; 384/220; D11/132, 137, 165, 168, 173; 404/9

[56] References Cited

U.S. PATENT DOCUMENTS

| | | | |
|---|---|---|---|
| D. 133,697 | 9/1942 | Cook, Jr. . | |
| D. 181,663 | 12/1957 | Morton . | |
| D. 252,806 | 9/1979 | Richter nee Redomske . | |
| D. 263,815 | 4/1982 | Ornatek . | |
| D. 328,681 | 8/1992 | Radosevich . | |
| 624,639 | 5/1899 | Frazee et al. | 40/617 |
| 865,255 | 9/1907 | Kelley | 40/584 |
| 1,642,022 | 9/1927 | Groh . | |
| 1,845,967 | 2/1932 | Fox | 40/607 |
| 2,799,240 | 7/1957 | Andrews | 116/174 |
| 2,887,983 | 5/1959 | Budd | 40/602 |
| 2,888,900 | 6/1959 | Scarlet . | |
| 3,032,906 | 5/1962 | Stein . | |
| 3,042,940 | 7/1962 | Keaton . | |
| 3,056,377 | 10/1962 | Nelson . | |
| 3,119,370 | 1/1964 | Keats | 116/173 |
| 3,200,786 | 8/1965 | Swezy et al. . | |
| 3,241,516 | 3/1966 | Hopkins | 116/173 |
| 3,436,077 | 4/1969 | Geram | 116/173 |
| 3,765,065 | 10/1973 | Hay | 24/456 |
| 3,812,815 | 5/1974 | Kuenzel | 116/173 |
| 3,815,412 | 6/1974 | Keim | 116/173 |
| 4,574,726 | 3/1986 | Sullivan | 116/174 |
| 4,767,088 | 8/1988 | Fielder et al. | 248/121 |
| 4,817,944 | 4/1989 | Anderson et al. | 482/107 |
| 5,016,373 | 5/1991 | Theno | 40/617 |

FOREIGN PATENT DOCUMENTS

| | | | |
|---|---|---|---|
| 4-92010 | 3/1992 | Japan | 404/9 |

*Primary Examiner*—William A. Cuchlinski, Jr.
*Assistant Examiner*—Andrew Hirshfeld
*Attorney, Agent, or Firm*—Pitts & Brittian

[57] ABSTRACT

An ornamental flag having a silhouette image and an improved flag suspension assembly. The flag has a substantially continuous border and an image therein. The image is provided with a substantial area of cut-out about its perimeter thereby presenting a silhouette of the image. A loop is provided along a substantial portion of the lower edge of the flag's width and/or length for receiving a flag pole thereby allowing the flag to swivel about the pole. In order to prevent the flag from sliding down the flag pole, a grommet having an internal elastomeric O-ring is positioned on the pole adjacent the inward edge of the flag. The O-ring preferably has an interior diameter slightly less than the exterior diameter of the pole such that the O-ring engages the flag pole in a tight frictional fit, but is slidable along the length of the flag pole. Additionally, the lower edge of the flag is provided with a smaller loop that receives an elongated dowel member that maintains the lower edge in a straight manner and adds weight to the lower edge.

1 Claim, 3 Drawing Sheets

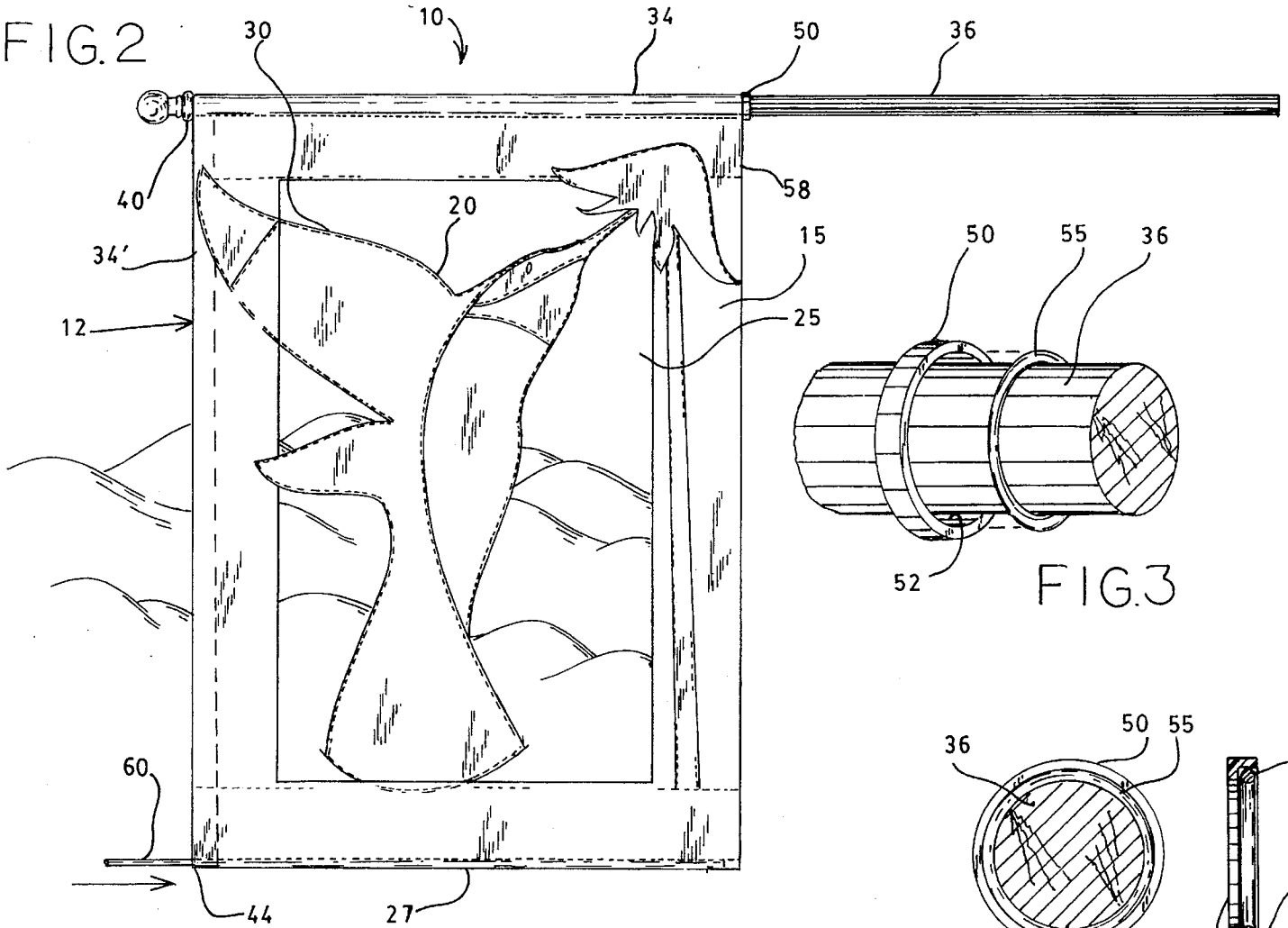
FIG.2
FIG.3
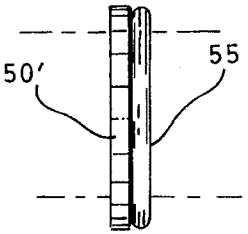
FIG.4
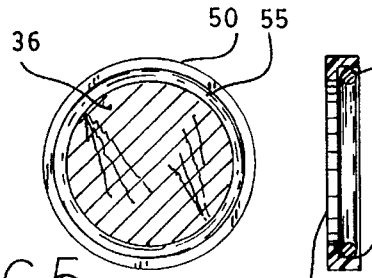
FIG.5
FIG.6

SILHOUETTE IMAGE FLAG WITH CUT-OUTS AND IMPROVED FLAG SUSPENDING ASSEMBLY

TECHNICAL FIELD

This invention relates to the field of ornamental flags and an improved flag suspending assembly. More specifically, it relates to an ornamental flag having a silhouette cut-out and having an improved assembly for suspending the flag from a flag pole in a manner that prevents the flag from becoming tangled or wrapped around the flag pole.

BACKGROUND ART

It has become increasingly popular in recent years to decorate the front or rear of one's home, yard or terrace with ornamental flags depicting, variously, flowers, birds, small animals, religious symbols, family crests or hobby-icons. Typically, these flags are suspended from a pole in a conventional manner, often horizontally. Inasmuch as a flag presents a large surface area to wind, the flag can wrap around a pole and become tangled on the pole in strong wind. It is known in the art that banners and the such can be provided with slits to allow wind to blow through the banner. However, what is needed is a flag with a large surface-area cut-out that forms an essential part of the design-aesthetic of the flag, creating a silhouette of an image. Also what is needed is an improved flag suspension assembly for allowing the flag to swivel on the pole without wrapping around the pole.

Accordingly, it is an object of this invention to provide a flag with a large surface-area cut-out that forms an essential part of the aesthetics of the flag, thus allowing passage of wind through the flag while simultaneously creating a silhouette of an image on the flag thus complementing the aesthetic image of the flag.

Yet another object of the present invention is to provide an improved flag suspension assembly for allowing the flag to swivel on the pole without wrapping around the pole.

Other objects and advantages over the prior art will become apparent to those skilled in the art upon reading the detailed description together with the drawings as described as follows.

DISCLOSURE OF THE INVENTION

In accordance with the various features of this invention, an ornamental flag having a silhouette image and an improved flag suspension assembly is provided. The flag has a substantially continuous border and an image therein. The image is provided with a substantial area of cut-out about its perimeter thereby presenting a silhouette of the image. The flag is provided with a loop along a substantial portion of its width and/or length for receiving a flag pole. The loop allows the flag to swivel about the pole without wrapping around the pole. Preferably, the flag pole is provided with an end having a cross-sectional area larger than the loop for preventing the flag from sliding off of the outward end of the flag pole. To prevent the flag from sliding down or off of the inward end of the flag pole, a grommet having an internal elastomeric O-ring is positioned on the pole adjacent the inward edge of the flag. The elastomeric O-ring preferably has an interior diameter slightly less than the exterior diameter of the pole such that the O-ring engages the flag pole in a tight frictional fit, but is slidable along the length of the flag pole.

Additionally, the lower edge of the flag is weighted. In this regard, the lower edge of the flag is provided with a smaller loop that receives an elongated dowel member that maintains the lower edge in a straight manner and adds weight to the lower edge.

BRIEF DESCRIPTION OF THE DRAWINGS

The above mentioned features of the invention will become more clearly understood from the following detailed description of the invention read together with the drawings in which:

FIG. 2 illustrates a rear elevational view of the silhouette flag of the present invention and background terrain.

FIG. 3 illustrates a perspective view of the grommet and internal O-ring that maintains the flag of the present invention in position on the flag pole.

FIG. 4 illustrates a side view of an alternate embodiment of the grommet and O-ring of the present invention.

FIG. 5 illustrates an end view of the grommet and internal O-ring, shown in FIG. 3, invention in position on the flag pole.

FIG. 6 illustrates a cross-section view of the grommet and internal O-ring, shown in FIG. 3.

BEST MODE FOR CARRYING OUT THE INVENTION

Figure 1:
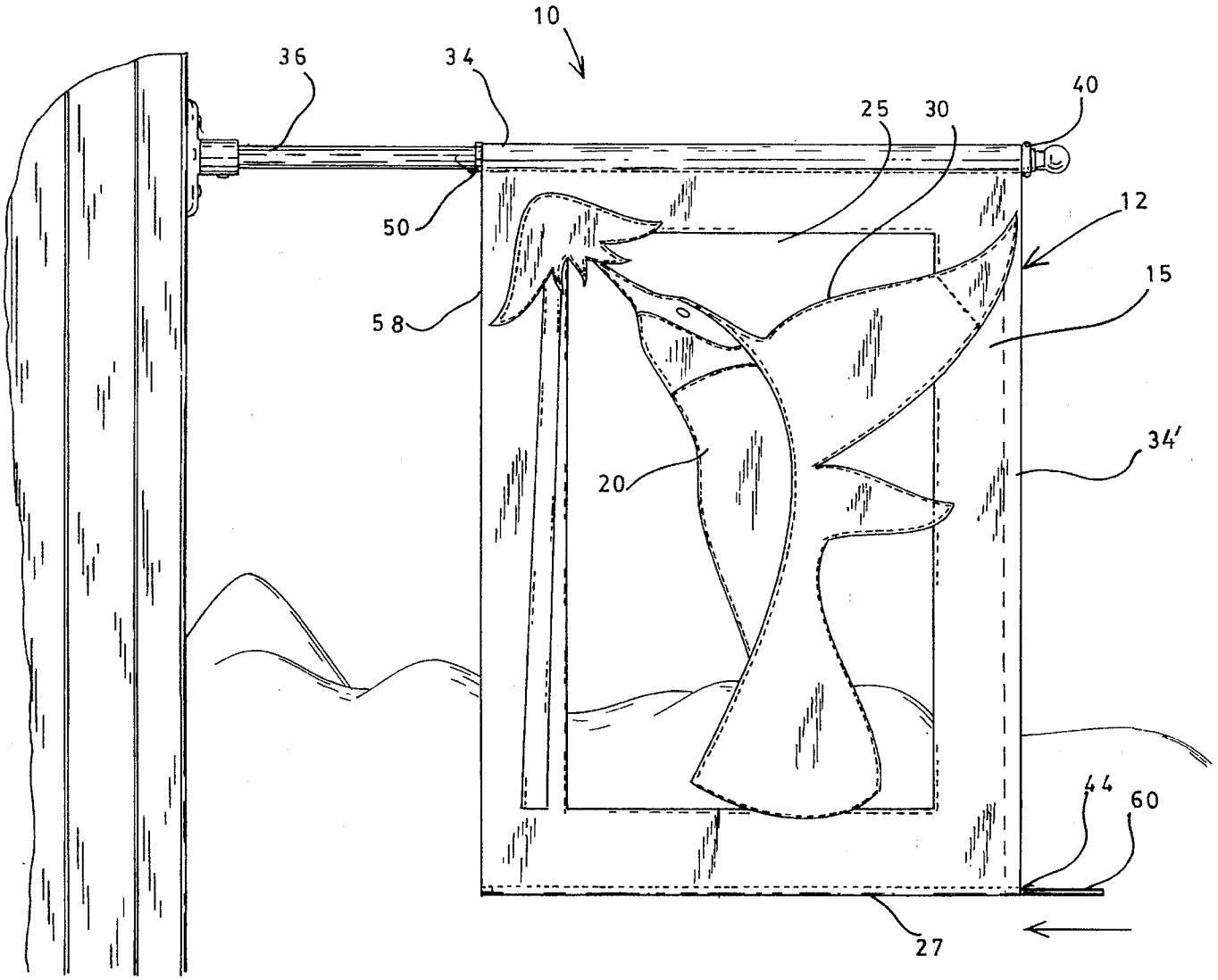
FIG. 1 illustrates a front elevational view of the silhouette flag of the present invention and background terrain.
Figure 7:
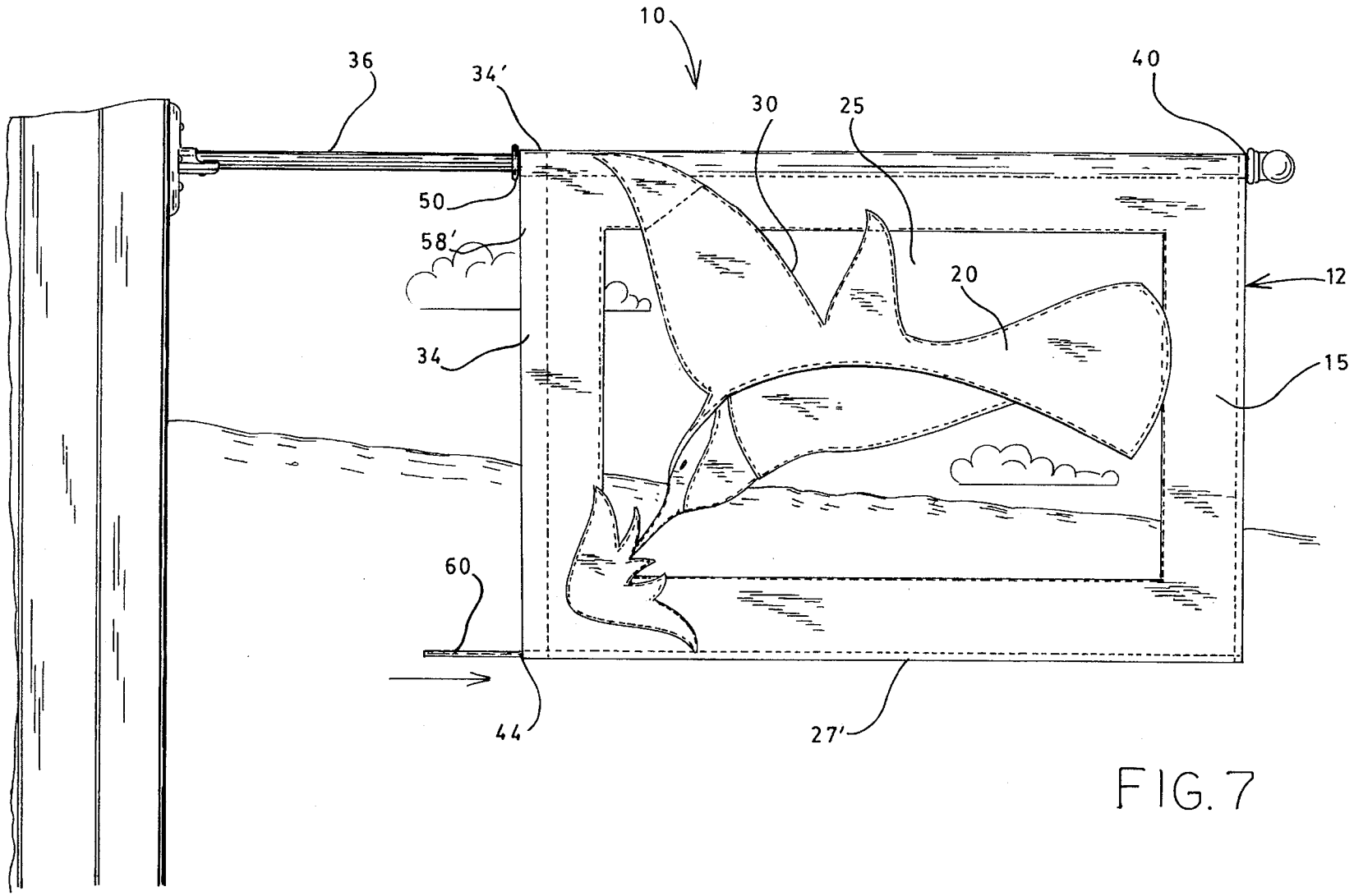
FIG. 7 illustrates an alternate embodiment of the silhouette flag of the present invention.

An ornamental flag having a silhouette image and an improved flag suspension assembly constructed in accordance with the present invention is illustrated generally as 10 in the figures. Flag 12 has a substantially continuous border 15 and an image 20 therein. Image 20 is provided with a substantial cut-out area 25 about its perimeter 30 thereby presenting a silhouette of image 20. Flag 12 is provided with a loop 34 along a substantial portion of its width for receiving a flag pole 36. Those skilled in the art will appreciate that flag 12 can be hung vertically, as seen in FIGS. 1 and 2, or can be hung horizontally, as seen in FIG. 7. So that flag 12 may be hung horizontally, loop 34' is provided along a substantial portion of the length of flag 12 for receiving flag pole 36. Loop 34 allows flag 12 to swivel about flag pole 36 without wrapping around the pole. Preferably, flag pole 36 is provided with an end 40 having a cross-sectional area larger than loop 34 for preventing flag 12 from sliding off of the outward end of flag pole 36.

To prevent flag 12 from sliding down or off of the inward end of flag pole 36, a grommet 50 having an internal elastomeric O-ring 55 is positioned on flag pole 36 adjacent the inward edge of flag 12. Elastomeric O-ring 55 preferably has an interior diameter slightly less than the exterior diameter of flag pole 36 such that O-ring 55 engages flag pole 36 in a tight frictional fit, but is slidable along the length of the flag pole 36. Grommet 50 is positioned adjacent the inward edge 58 of flag 12. Grommet 50 is interposed between O-ring 55 and inward edge 58 such that O-ring 55 acts as a stop member. In the preferred embodiment, grommet 50 has annular recess 52 that receives O-ring 55. In an alternate embodiment, grommet 50' (seen in FIG. 4), would be substantially planar and would abut O-ring 55.

Additionally, in the preferred embodiment, the lower edge 27, (27' in FIG. 7), of flag 12 is weighted. In this regard, lower edge 27 of flag 12 is provided with a smaller loop 44 that receives an elongated dowel member 60 that maintains lower edge 27 in a straight manner and adds weight to lower edge 27.

From the foregoing description, it will be recognized by those skilled in the art that a silhouette image flag with cut-outs and improved flag suspending assembly offering advantages over the prior art has been provided. Specifically, the silhouette image flag with cut-outs and improved flag suspending assembly provides a flag with a large surface-area cut-out that forms an essential part of the aesthetics of the flag, thus allowing passage of wind through the flag while simultaneously creating a silhouette of an image on the flag thus complementing the aesthetic image of the flag. Also the silhouette image flag with cut-outs and an improved flag suspending assembly provides an improved flag suspension assembly for allowing the flag to swivel on the pole without wrapping around the pole.

While a preferred embodiment has been shown and described, it will be understood that it is not intended to limit the disclosure, but rather it is intended to cover all modifications and alternate embodiments falling within the spirit and the scope of the invention as defined in the appended claims.

Having thus described the aforementioned invention,

I claim:

1. An ornamental flag assembly having an improved flag suspension assembly, said ornamental flag assembly comprising;

a planar flag member having a length, a width, an upper edge, a lower edge disposed oppositely from said upper edge, a substantially continuous border and an image therein, said image having a perimeter;

a cut-out area having a substantially large surface-area, said cut-out area being disposed within said substantially continuous border substantially about said perimeter wherein said perimeter of said image appears as a substantial silhouette of said image;

a first loop disposed along said upper edge of said planar flag member and receiving a flag pole, said first loop thereby allowing said planar flag member to swivel about said flag pole without wrapping around said flag pole;

a second loop disposed along said lower edge of said planar flag member, wherein said second loop is of a smaller diameter than said first loop;

an elongated dowel member, wherein said elongated dowel member is received within said second loop, said elongated dowel member thereby maintaining said lower edge in a straight manner and adding weight to said lower edge;

a grommet member for preventing said planar flag member from sliding upon said flag pole, said grommet member having an internal annular recess; and an elastomeric O-ring received by said annular recess for supporting said grommet member, said elastomeric O-ring having an interior diameter slightly less than the exterior diameter of said flag pole such that said elastomeric O-ring engages said flag pole in a tight frictional fit, and further wherein said elastomeric O-ring is slidable along the length of said flag pole.

* * * * *